US006984316B2

(12) United States Patent
Tannenberg

(10) Patent No.: US 6,984,316 B2
(45) Date of Patent: Jan. 10, 2006

(54) DEVICE FOR CREATING AT LEAST ONE REACTION ZONE IN AN AQUIFER

(75) Inventor: Dan Tannenberg, Trollhättan (SE)

(73) Assignee: Swiss Investment and Trust Corporation, British Virgin Island (LI)

( * ) Notice: Subject to any disclaimer, the term of this patent is extended or adjusted under 35 U.S.C. 154(b) by 0 days.

(21) Appl. No.: 10/462,543

(22) Filed: Jun. 16, 2003
(Under 37 CFR 1.47)

(65) Prior Publication Data

US 2004/0108279 A1 Jun. 10, 2004

Related U.S. Application Data

(63) Continuation of application No. PCT/SE01/02757, filed on Dec. 12, 2001.

(30) Foreign Application Priority Data

Dec. 15, 2000 (SE) ..... 0004676

(51) Int. Cl.
*B01D 63/00* (2006.01)

(52) U.S. Cl. ..... 210/170; 210/220; 210/198.1; 405/52; 405/59

(58) Field of Classification Search ..... 210/170, 210/220, 198.1; 166/245, 246, 268, 300, 166/305.1, 67, 52, 370; 405/125.15, 128.5, 405/129.25, 53, 59, 52
See application file for complete search history.

(56) References Cited

U.S. PATENT DOCUMENTS 4,388,192 A * 6/1983 Hellqvist ..... 210/615
5,322,128 A 6/1994 Bernhardt
5,468,097 A 11/1995 Bernhardt

FOREIGN PATENT DOCUMENTS

SE 434388 7/1984
SE 466851 4/1992

* cited by examiner

*Primary Examiner*—Chester T. Barry
(74) *Attorney, Agent, or Firm*—Gauthier & Connors LLP

(57) ABSTRACT

The present invention relates to a device for creating a reaction zone in an aquifer, for circulating and purifying ground and raw water, in particular for tap water use, which aquifer comprises satellite wells and at least one extraction well wherein each satellite well comprises at least two, essentially vertical water conducting sections separated from each other in substantially vertical longitudinal direction, and having at least two geohydrologic zones, whereby said zones are arranged to alternating emit water to the surrounding, and receive water coming from the outside surrounding, respectively, whereby adjacent wells are arranged for opposite flows so that substantially horizontal flows are obtained in a water leading layer, in which layer the wells have been placed between adjacent wells, and whereby the water of at least one section is arranged to be pumped in one direction from below and upward, and at least in one vertical section, form above and downward, respectively, and to be lead out through at least one second section, and whereby the flow is obtained by lifting device arranged in the bottom part of the respective section, as well as a method for purification of ground or raw water in an aquifer by means of a number of satellite wells and at least one extraction well.

7 Claims, 7 Drawing Sheets

DEVICE FOR CREATING AT LEAST ONE REACTION ZONE IN AN AQUIFER

This is a continuation of copending application International Application PCT/SE01/02757 filed on Dec. 12, 2001 and which designated the U.S.

TECHNICAL FIELD

The present invention relates to a device as well as a method for creating a reaction zone in an aquifer, for circulating and purifying ground and raw water, in particular for tap water use, which aquifer comprises satellite wells and at least one extraction well.

The object of the present invention is to obtain a device and a method for creating a reaction zone in an aquifer to increase the capacity of the aquifer for purifying ground and raw water, which water suitably is to be used as a tap water.

In the present invention the term satellite wells is used to define on one hand commonly used injection wells, but also wells, which may function on one hand as injection wells, on the other as extraction wells.

BACKGROUND OF THE INVENTION

Ground water and raw water, which are used for tap water production often contain high amounts of iron and manganese with regard to health, and these amounts have to be reduced before the water, from health and taste reasons, can be used as tap water. EP-A-0 160 774 describes the use of a zone for oxidation and precipitation of iron and manganese where water containing oxygen or oxygen producing compounds intermittent are added to the zone via satellite wells arranged around extraction wells. Hereby water is fed only to a few satellite wells and simultaneously water is extracted from adjacent situated satellite wells. Oxygen added creates a suitable growth environment for microorganisms present in the ground, which microorganisms together with chemical and/or biochemical processes provides for a precipitation of iron and manganese in the zone/ground layer, which will serve as a filter as well.

EP-A-0 154 105 describes reduction of nitrate in ground water by means of denitrification in a reduction zone created between injection wells also arranged around one or more extraction wells.

It is previously known to create reaction zones in aquifers to obtain an oxidation and a precipitation zone or a reduction zone between a number of injection wells arranged around one or more extraction wells in such reaction zones, whereby the zone desired is created intermittently or continuously between each pair of adjacently situated injection wells by introducing oxygen, oxygen containing gas or oxygen releasing compounds in the water of the two wells when one creates an oxidation and precipitation zone, or introduce an oxygen consuming compound in the two wells to obtain a reduction zone, and whereby one pumps the water of one of the wells from below and up, and from the top and downward in the other well so that a circulation circuit is created in the aquifer between the two wells.

Thereby the injection wells consist of an outer tube being perforated and water permeable at least in the ground water containing part of the tube. In SE-C-466 851 there is a solution where an injection well tube contains a sealing around an intermediate tube part introduced into the outer tube, and where one by arranging different air supply tubes obtains a desired flow direction in the respective injection wells to obtain a top-downward, and below-upward flow, respectively. By operating with air as a transport directing means it is, however, difficult to reach a reduction in the aquifer without adding an excess of reducing agent as the air contains about 21% of oxygen.

In another embodiment of this idea one has a first tube outgoing from a circulation vessel arranged in the upper part of the injection well tube, which first tube ends in the upper part of the aquifer, and which well tube at its mouth is provided with a first pressure inlet means to form an upper injector, and a second tube being tightly sealed off from the upper part by means of a balloon shaped body, whereby the second tube receives a second pressure inlet means arranged above the sealing means to form a second injector so that when the first pressure inlet means is being activated water will become sucked into the upper part of the injection well tube and be pressed upwardly in the first tube, and downward into the second tube to be pressed out into the aquifer while when the second pressure inlet means is being activated water is sucked in from the lower part of the injection well tube and is pressed upward in the second tube and out through the first tube and from there, out into the aquifer.

The problem of these embodiments is that no correct control of the flows between different injection wells is not obtained as the hydraulic situation from one well is divided into two layers using a sealing which means partly a precipitation problem, partly a bad circulation.

DESCRIPTION OF THE PRESENT INVENTION

It has now surprisingly turned out possible to solve this problem and to share the aquifer in a simple way by means of the present invention, which is characterized in that each satellite well comprises at least two, essentially vertical water conducting sections separated from each other in substantially vertical longitudinal direction, and having at least two geohydrologic zones, whereby said zones are arranged to alternating emit water to the surrounding, and receive water coming from the outside surrounding, respectively, whereby adjacent wells are arranged for opposire flows so that substantially horizontal flows are obtained in a water leading layer, in which layer the wells have been placed, between adjacent wells, and whereby the water of at least one section is arranged to be pumped in one direction from below and upward, and at least in one vertical section, from above and downward, respectively, and to be lead out through at least one second section, and whereby the flow is obtained by a lifting device arranged in the bottom part of the respective section.

Further characteristics are evident from the accompanying claims.

According to a preferred embodiment of the present invention every well comprises a double well comprising two substantially vertical water conducting sections separated from each other and where one part of the double well is provided with an upper geohydrologic zone, and the other part of the double well is provided with a lower geohydrologic zone, whereby said zones are arranged to alternating emit water to the surrounding, and to receive water coming from the outside, respectively, and whereby each substantially vertical section comprises a lifting device.

According to another preferred embodiment of the invention each well comprises a triple well comprising three substantially vertical water conducting sections sealingly separated from each other and where one part of the triple well is provided with an upper geohydrologic zone, a second part of the triple well is provided with an intermediately placed geohydrologic zone and a third part of the triple well is provided with lower geohydrologic zone, whereby said zones are arranged to alternating emit water to the surrounding, and to receive water coming from the outside, respectively, and whereby each substantially vertical section comprises a lifting device.

According to another preferred embodiment of the present invention the well tubes comprises raising tubes, which end in a exhaust container and which raising tubes at the bottom section comprise ejectors, which work with air added via an air conduit arranged in the well tube.

According to another further preferred embodiment of the invention devices for addition of additives are arranged.

Another aspect of the invention is a method for obtaining at least one reaction zone for the purification of ground and raw water in anaquifer by means of a number of satellite wells and at least one extraction well, whereby water is introduced in each satellite well comprising at least two substantially vertical water conducting sections separated from each other in substantially vertical longitudinal direction and having at least two geohydrologic zones, whereby said zones are arranged to alternating emit water to the surrounding and to receive from the outside surrounding coming water, respectively, whereby adjacent wells are arranged for opposite flows so that essentially horizontal flows are obtained in water conducting layer into which the wells are placed, between adjacent wells, and whereby the water in at least one vertical section is arranged to be pumped in a direction from below and upward, and in at least one vertical section, be fed from above and downward, respectively, and out through at least one second section, and whereby the flow is obtained by a lifting device being arranged in the bottompart of the respective section.

According to a preferred embodiment of this aspect of the invention, hydrocalcite, sodium hydroxide, sodium carbonate, hydrochloric acid, oxalic acid, oxygen, air, or oxygen enriched air, gases are introduced into the reaction zone and/or water for the growth of bacteria, bacterial cultures, oxygen free gas, denitrification microorganisms or nutrients for such.

According to another preferred embodiment of the method the reaction zone is an oxidation and precipitation zone.

According to another further preferred embodiment of the invention the reaction zone is a reduction zone.

According to another embodiment of the invention satellite wells are arranged in such a way that one obtains on one hand at least one oxidation zone, on the other hand at least one reduction zone.

By means of the present invention it is obtained that at least one well in a combination of wells at one time point only emits water through over pressure to the surrounding via one section and receives/sucks water in a second section, whereby adjacent satellite wells can be so controlled so that emission e.g., in a lower section from one well corresponds to a vacuo/suction in a lower section of a second well. This means that the ground layers in which the water is present for obtaining a reaction and which is a reaction zone is utilized horizontally in a more suitable way.

The present invention can suitably be used in natural as well as artificial aquifers using natural ground water or induced raw water and is particularly designed for the production of tap water.

Different additives can be added to the water in order to carry out a reaction in the reaction zone, such additives are hydro calcite, sodium hydroxide, sodium carbonate, hydrochloric acid, oxalic acid, oxygen gas for a rapid oxidation, air, or oxygen enriched air, gases such as methane for e.g., growth of bacteria which grow on compounds present in the water, bacterial cultures, which one depends on what should be removed from the water, oxygen free gas such as nitrogen, denitrification microorganisms or nutrients for such, such as sugar or molasses, methanol, ethanol, or an acetate, such as sodium acetate or calcium acetate, i.a. But an iron (II) salt can also be added to obtain a reduction and complexformation in the reaction zone.

Satellite wells and extraction wells are arranged in a geohydrologic field. This can mean that one drills down beneath buildings whereby satellite wells and extraction wells may be arranged obliquely in the ground in relation to the vertical plane.

The present invention will now be described more in detail with reference to the preferred embodying examples shown in the accompanying drawing, in which FIG. 1 shows a preferred well according to the invention in a double tube embodiment;

Figure 1:
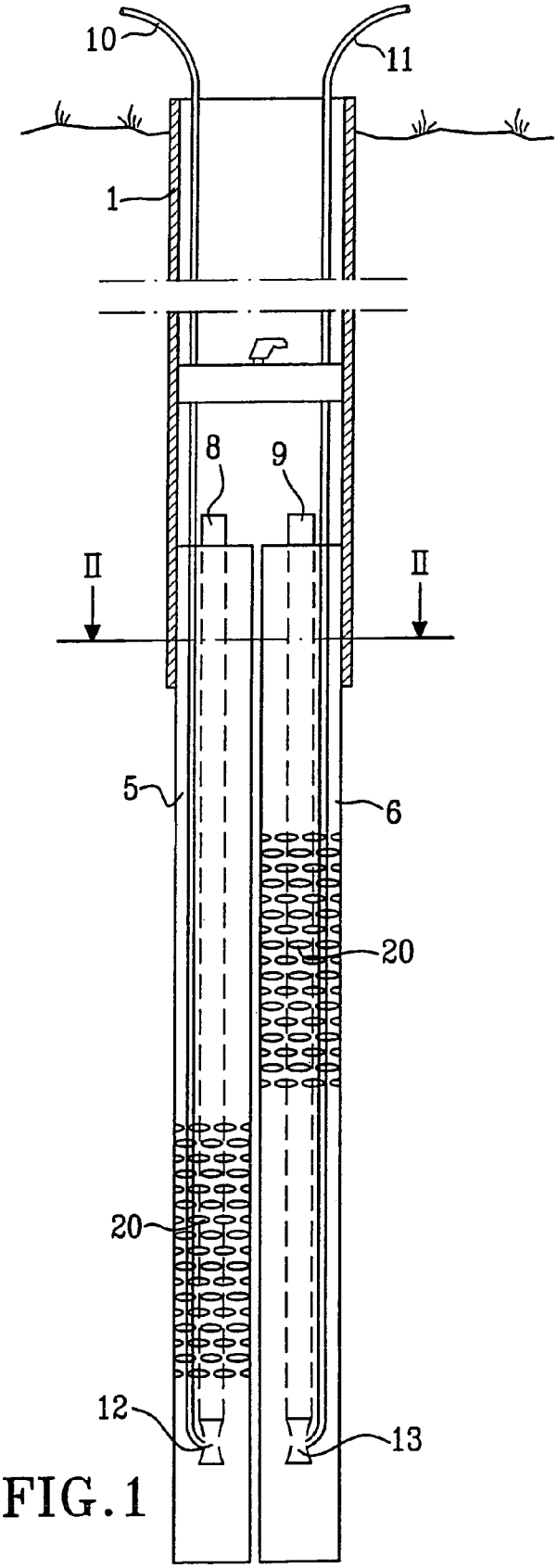
Figure 2:
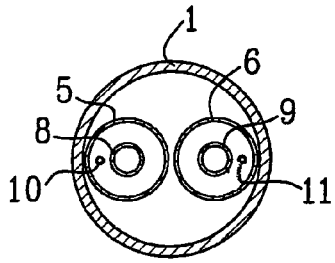
FIG. 2 shows a cross-section of the well according to FIG. 1 along the line II—II of FIG. 1.

1 denotes a casing pipe of a sw, which casing pipe 1 leads down to an area shortly above a ground water level 2 in a water bearing layer 3. The casing pipe 1 is the upper part of a drilled hole 4 in said water bearing layer. Two well pipes 5, 6 are pushed down, into this water bearing layer 3, of which one pipe 5 is provided with slots 20 in an upper geohydrologic section, and the other 6 is provided with slots in a lower geohydrologic section. The well pipes 5, 6, which constitute vertically separated sections so that the drilled hole will be divided into two vertical halves. In each well pipe 5, 6 there is a raising tube 8, 9 as well as an air conduit 10, 11 which lead down to and are arranged to ejectors 12, 13 arranged in the lower part of the respective raising tube 8, 9. The ejectors 12, 13 are identical and have the same flow properties.

Figure 8:
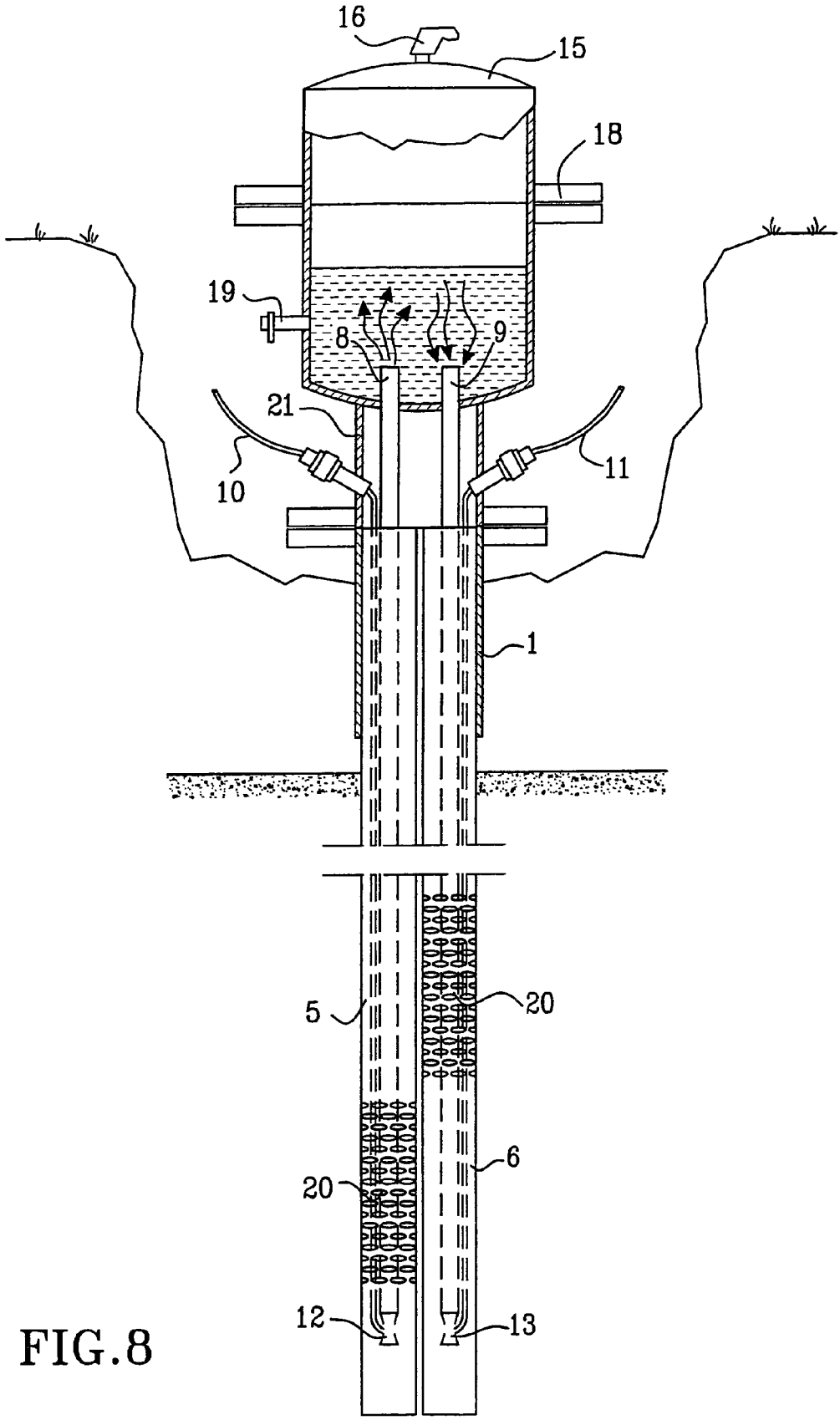
FIG. 8 shows another preferred embodiment of the invention in a longitudinal cross-section.

As evident from FIG. 8 the casing pipe 1 is placed at the ground level and the raising tubes 8, 9 end in an exhaust container 17, which is connected to the casing pipe 1 by means of a flange joint 18. The exhaust container 17 also contains a dosage opening 19 for the dosage of optional chemicals and other additives. Addition of air is arranged to be made through air conduits 10, 11 arranged through support tubes 21 of said exhaust container 17. The air conduits 10, 11 are arranged to ejectors 12, 13 arranged at the bottom of the respective raising tubes 8, 9.

Figure 3:
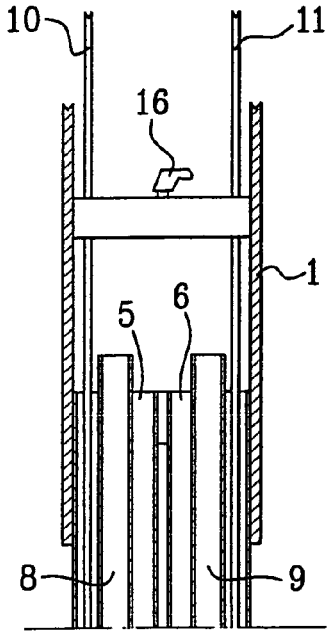
FIG. 3 shows a detail of the upper part of the well according to FIG. 1.

As evident from FIG. 3 there is a stainless steel pipe 14 present above the well pipes 5, 6 and in particular above the raising tubes 8, 9, which pipe 14 is provided with a lid 15. The stainless steel pipe 14 is arranged for exhausting water pumped up in the raising tubes 8, and 9, alternatively, before it turns down into raising tube 9, and 8, alternatively. The lid

15 is provided with an outlet 16 for any gas, which has been released from the water and gas/air which has been used for operating the ejectors 12, 13. A dosage opening 19 may also be present in the lid 15.

In the embodiments shown herein the well pipes of the sws have been shown as cylindrical pipes, which are brought down into the drilled holes, whereupon filling material, such as sand and gravel is brought down into the drilled holes, as a package around the pipes. However, it is also possible to prepare the well pipes as half-circular units which are brought down with their planar surfaces facing each other, whereby a filling of the drilled holes is obtained.

Figure 4:
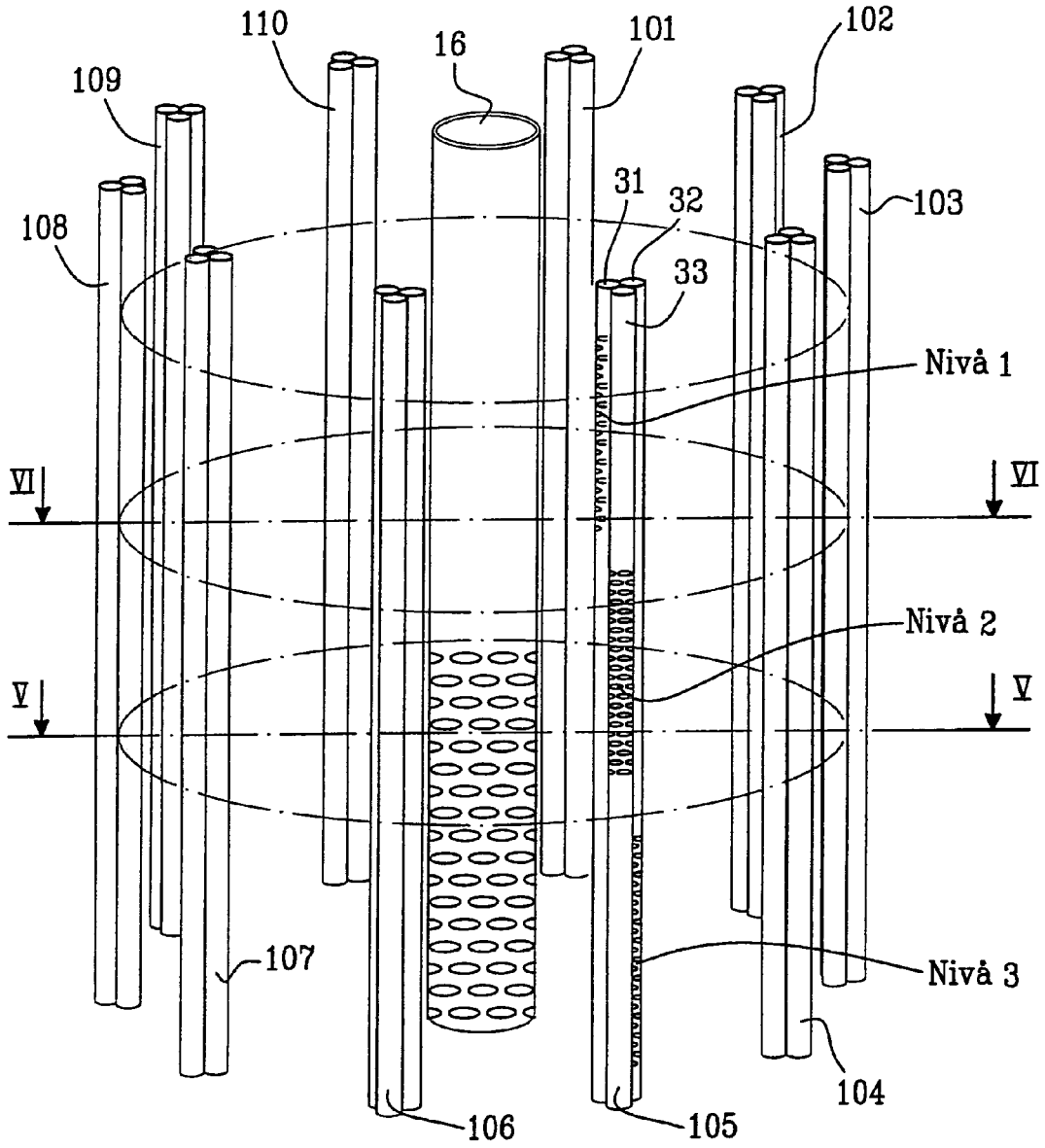
FIG. 4 shows in a perspective view a set-up of satellite wells in a three tubes embodiment having a centrally placed extraction well.
Figure 5:
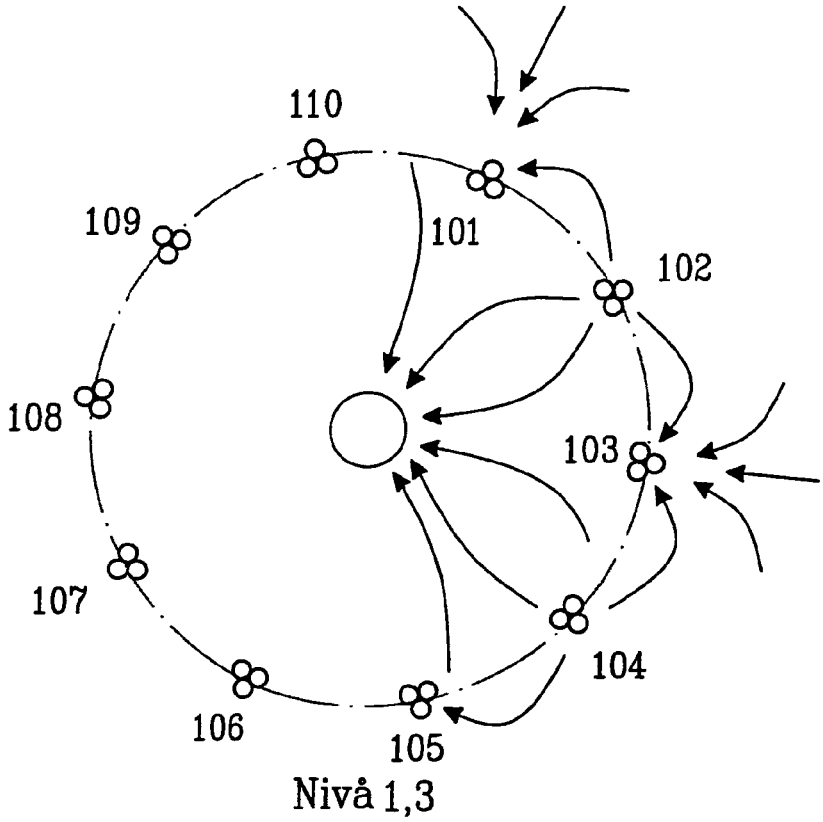
FIG. 5 shows the embodiment according to FIG. 4 in a cross-section along line V—V in FIG. 4.
Figure 6:
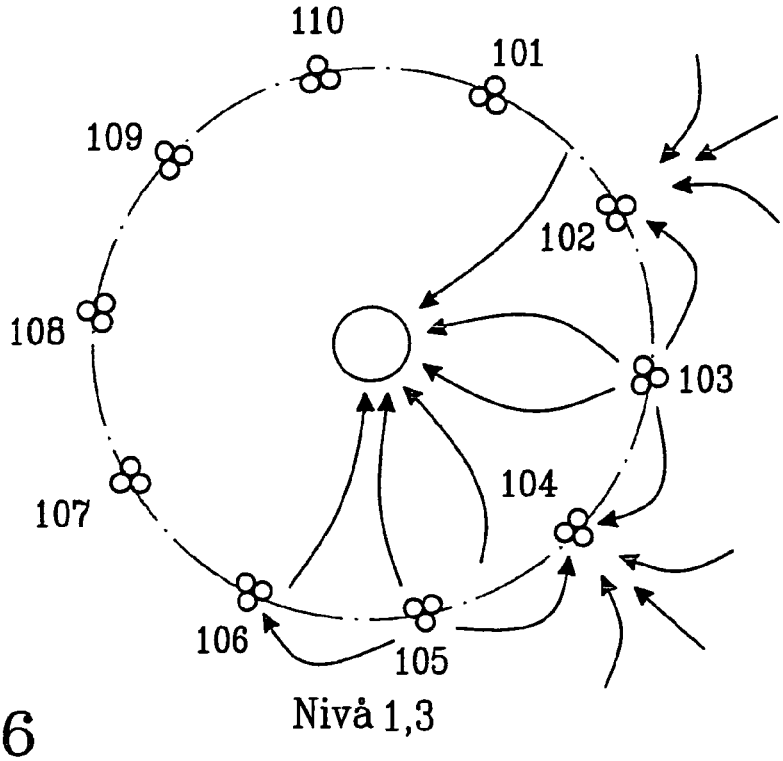
FIG. 6 shows the embodiment according to FIG. 4 in a cross-section along line VI—VI in FIG. 4.

As evident from FIG. 4 a number of well pipes 31, 32, 33 in groups of three and three are arranged in a water bearing filed in their respective well holes, as sws 101–110. In the centre of the arrangement there is an extraction or main well 16 through which water having been treated in the field is extracted for further treatment and/or distribution.

In these three-groups of well pipes 31, 32, 33 raising tubes, air conduits and ejectors are arranged, as in the earlier mentioned embodiments. Different from the previous embodiments the well pipes 31, 32, 33 taken together are slotted in three different sections, whereby thus in the example given well pipe 31 is slotted in an upper section, well pipe 32 in an intermediate section, and well pipe 33 in a lower section. This means that one can utilize three different levels of the water bearing field for obtaining reaction zones. Even in this type of embodiments emission into the geohydrologic zone is carried out by means of a super pressure, and the receiving of water from the geohydrologic zone is obtained by means of a vacuo created by the lifting devices.

Besides double wells and triple wells it is possible, in some cases to use multiple wells as sws. Thereby a great number of geologic layers can be laid out in a water bearing field.

Figure 7:
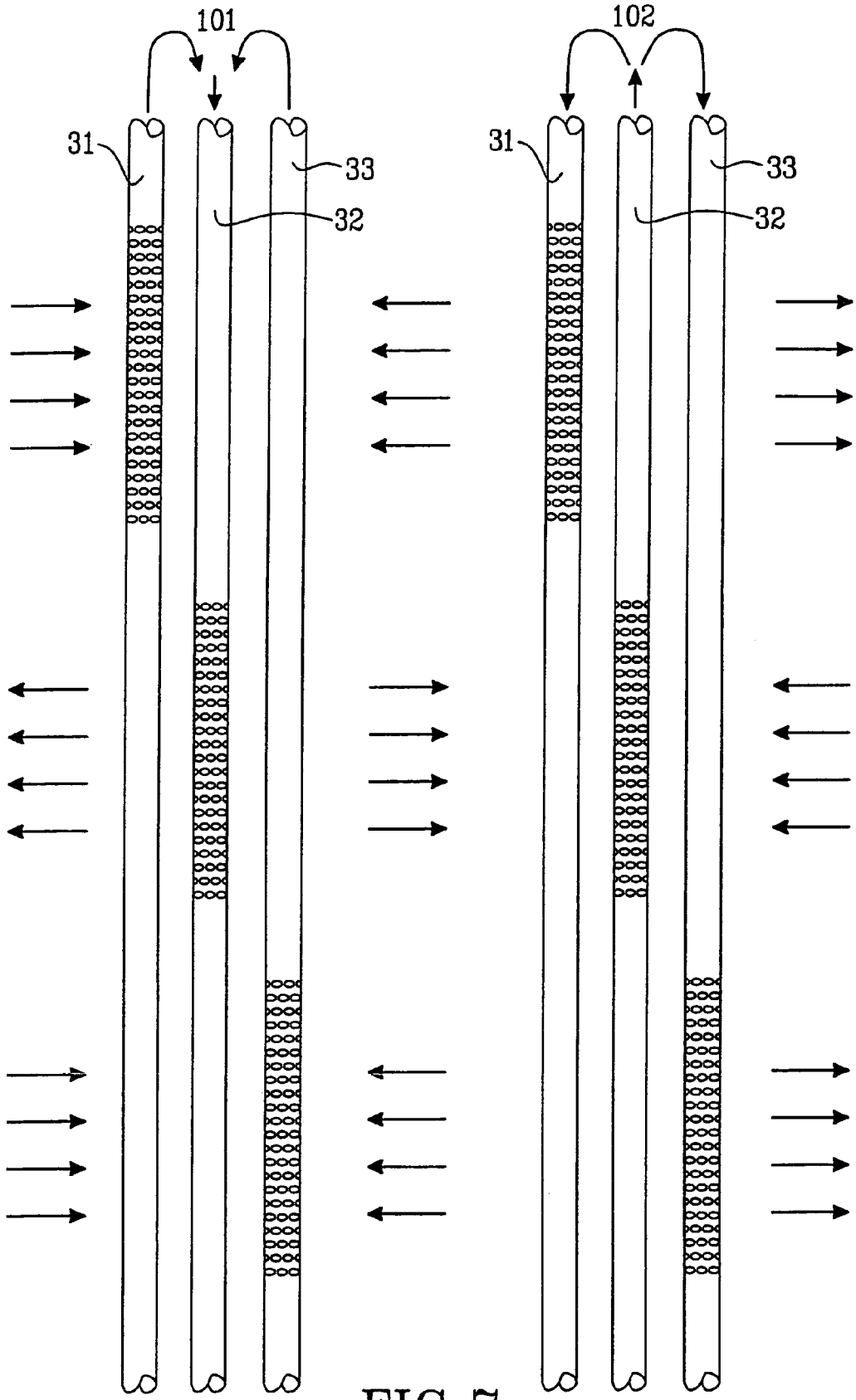
FIG. 7 shows a principal sketch of a three-group embodiment using three sws for illustrating a flow structure.

In FIG. 7 the flow structure between two groups of three well pipes 31, 32, 33 wherein the left group well pipes 31 and 33 have been activated, i.e., the ejectors of the raising tubes of these well pipes are functioning by means of air addition, while in the right hand group well pipe 32 has been activated. When a pipe is activated it means that it sucks water to itself due to the pumping force created by the ejectors, while when the pipes are inactivated, i.e., when the ejectors are not operating, but water turns in the respective exhaust containers, water will pressed out off the respective well pipe, as shown in FIG. 7

Figure 9:
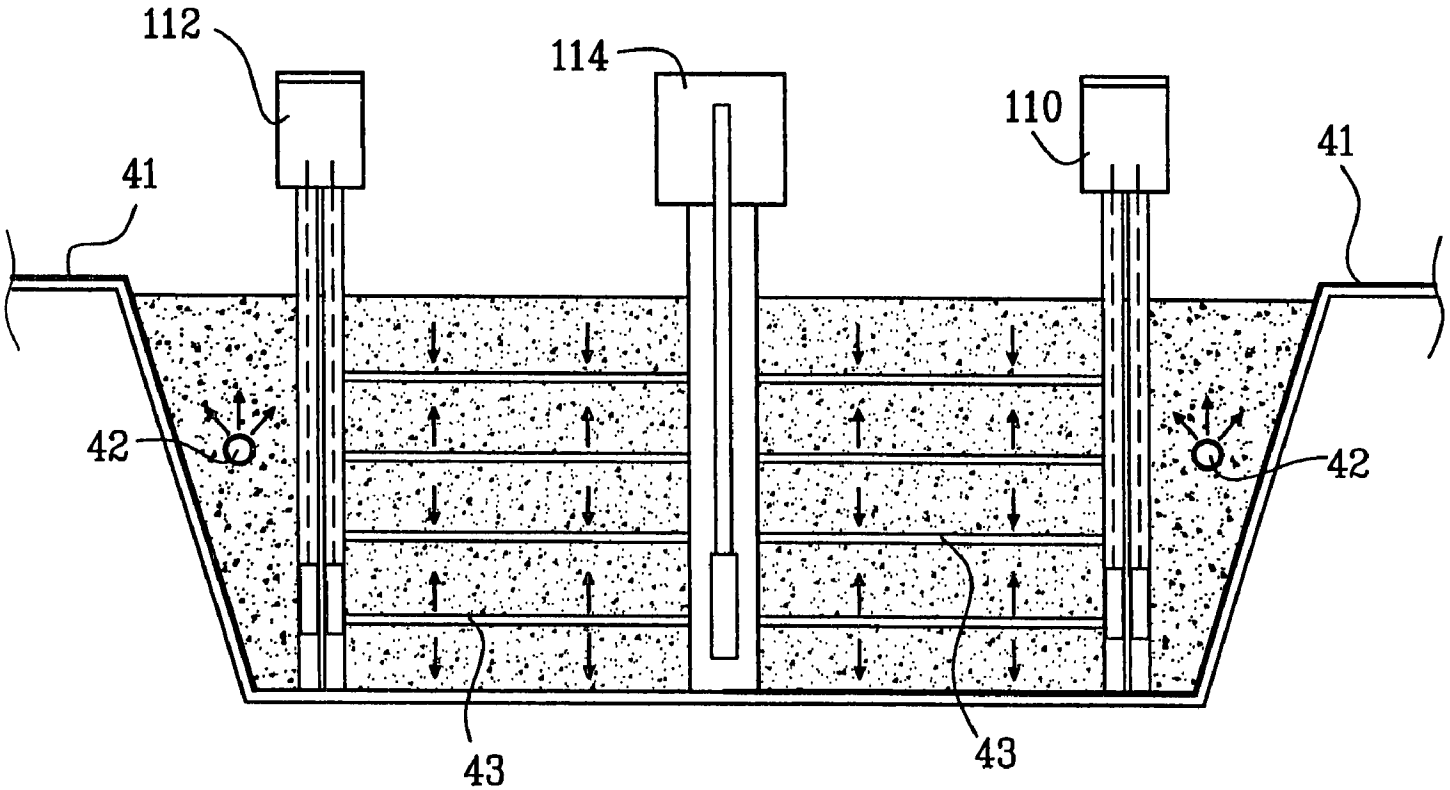
FIG. 9 shows a cross-section of an artificial aquifer.
Figure 10:
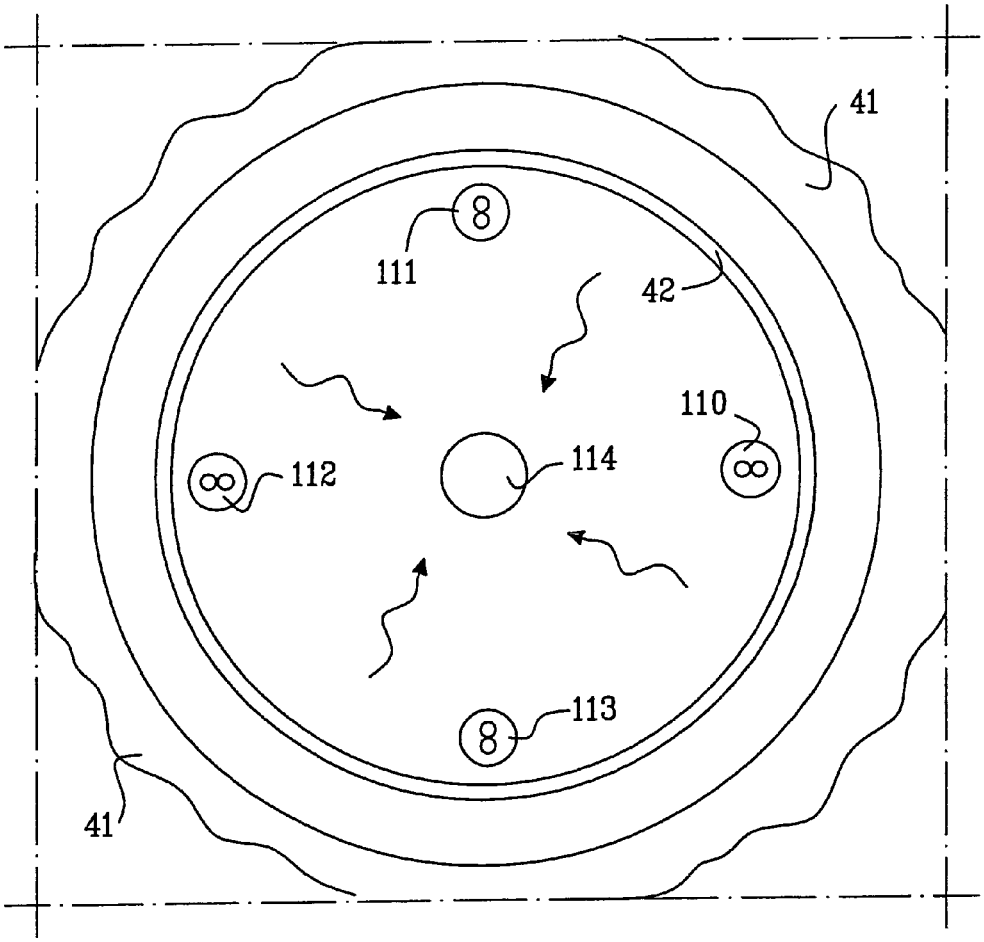
FIG. 10 shows the arrangement according to FIG. 9 seen from above.

In FIGS. 9 and 10 an artificial aquifer is shown, which has been obtained in a geological ground, which in itself is not suitable as an aquifer, but where conditions has been provided by excavation of a void which has been covered with an inert, tight cloth 41, and then been refilled with an inert aquifer material in the form of gravel having a particle size of about 2 to 16 mm, natural gravel or crushed marterial, in which material a number of wells 110–113 have been arranged as well as a withdrawal well 114. Raw water is introduced by means of a perforated conduit 42 to the aquifer. In this type of aquifer drainage tubes 43 between the wells 110–113 and the withdrawal well 114 be arranged. The tightening cloth 41 is arranged at a distance below the ground level and in such away that too much raw water in the aquifer will spill over into the surroundings. In this way a positive current will be formed which prevent any flowing in of non-controlled water.

A great advantage using the present invention compared with prior art is the fact that the ejectors operate from the same depth and with substantially the same flow, which creates very good conditions for even ground flows and thereby a substantially improved reaction zone in the ground. The risk for clogging will also be reduced by maintaining a flow in substantially the whole of the tubes.

The bore holes can be made considerably deeper than what is needed by the geological zones for the reason of increasing the pump flow in the respective single raising tubes.

The configuration of satellite wells can be very varying, e.g., elliptic, parable shaped, circular, arc formed, part of a circle, linear etc., all considering the geological conditions available and volume requests. The configuration can also be one or more of concentric or excentric circles where an oxidation zone is maintained in one area and a reaction zone is maintained in another area.

The configuration can also encompass combinations of double wells, triple wells or multi wells based on the geohydrological conditions.

Any change between satellite wells with regard to flow direction by means of the present invention will be done in a very simple way, which is simple controlled by means of the operation automatic system connected to the system.

The arrangement of double or triple wells also means that these can be arranged at a large depth as deep wells having the degassing vessel arranged below ground level. FIG. 1 shows a deep well application of a double well 5, 6 where the casing pipe extends down to a considerable depth into the ground and where a degassing vessel is present. The addition of air takes, as a principle, place in the same way as in the embodiment according to FIG. 8.

In the present embodying examples above air ejectors have been used as a transporting means of water in the raising tubes. Of course, other commonly used transporting means can be used, such as electrically, pneumatically, or hydraulically driven pumps of different types.

FIGURE REFERENCE DENOTATIONS

1 casing tube
2 water level
3 water providing layer
4 bore hole
5 well pipe
6 well pipe
8 raising tube
9 raising tube
10 air conduit
11 air conduit
12 ejector
13 ejector
14 tube
15 lid
16 outlet
17 exhaust container
18 flange joint
19 dosage opening
20 slots
21 supporting tube
31 well tube
32 well tube
33 well tube
41 tigthening cloth
42 perforated conduit
43 drainage tube
101–110 satellite wells

What is claimed is:

1. A device for creating a reaction zone in an aquifer, for circulating and purifying ground and raw water, in particular for tap water use, which aquifer comprises satellite wells and at least one extraction well, wherein each satellite well comprises at least two, essentially vertical water conducting sections separated from each other in substantially vertical longitudinal direction, and having at least two geohydrologic zones, whereby said zones are arranged to alternatingly emit water to the surrounding, and receive water coming from the outside surrounding, respectively, whereby adjacent wells are arranged for opposite flows so that substantially horizontal flows are obtained in a water leading layer, in which layer the wells have been placed, between adjacent wells, and whereby the water of at least one section is arranged to be pumped in one direction from below and upward, and at least in one vertical section, from above and downward, respectively, and to be lead out through at least one second section, and whereby the flow is obtained by a lifting device arranged in the bottom part of the respective section.

2. A device according to claim 1, wherein every well comprises a double well comprising two substantially vertical water conducting sections separated from each other and where one part of the double well is provided with an upper geohydrologic zone, and the other part of the double well is provided with a lower geohydrologic zone, whereby said zones are arranged to alternating emit water to the surrounding, and to receive water coming from the outside, respectively, and whereby each substantially vertical section comprises a lifting device.

3. A device according to claim 1, wherein each well comprises a triple well comprising three substantially vertical water conducting sections sealingly separated from each other and where one part of the triple well is provided with an upper geohydrologic zone, a second part of the triple well is provided with an intermediately placed geohydrologic zone and a third part of the triple well is provided with lower geohydrologic zone, whereby said zones are arranged to alternating emit water to the surrounding, and to receive water coming from the outside, respectively, and whereby each substantially vertical section comprises a lifting device.

4. A device according to claim 1, wherein the well tubes comprises raising tubes, which end in a exhaust container and which raising tubes at the bottom section comprise ejectors, which work with air added via an air conduit arranged in the well tube.

5. A device according to claim 1, wherein devices for addition of additives are arranged.

6. A device according to claim 1, wherein the device is arranged in a naturally occurring aquifer.

7. A device according to claim 1, wherein the device is arranged in an artificial aquifer.

* * * * *